US008089209B2

(12) United States Patent
Chen

(10) Patent No.: US 8,089,209 B2
(45) Date of Patent: Jan. 3, 2012

(54) ELECTRODLESS GLOBE FLORESCENT LAMP WITH HIGH LUMINANT EFFICIENCY

(75) Inventor: Min Chen, Fujian (CN)

(73) Assignee: Fujian Juan Kuang Yaming Electric Limited, Fujian (CN)

( * ) Notice: Subject to any disclaimer, the term of this patent is extended or adjusted under 35 U.S.C. 154(b) by 234 days.

(21) Appl. No.: 12/482,085

(22) Filed: Jun. 10, 2009

(65) Prior Publication Data

US 2009/0256466 A1 Oct. 15, 2009

(30) Foreign Application Priority Data

Mar. 24, 2008 (CN) ..... 2008 2 0101716 U

(51) Int. Cl.
*H01J 17/16* (2006.01)
*H01J 17/49* (2006.01)
*H01J 17/04* (2006.01)

(52) U.S. Cl. ..... 313/567; 313/234; 313/17; 313/607; 315/248

(58) Field of Classification Search ..... 313/486, 313/567, 488, 17, 607, 234; 315/248
See application file for complete search history.

(56) References Cited

U.S. PATENT DOCUMENTS

2007/0069647 A1 * 3/2007 Kakehashi et al. ..... 313/567

FOREIGN PATENT DOCUMENTS

JP 63313462 A * 12/1988

* cited by examiner

*Primary Examiner* — Joseph L Williams

(57) ABSTRACT

The present invention comprises a globe shield and an inner disposed inside the shield, between which a low-pressured plasmic arc discharging zone is enclosed. Further, a glass division device near the inner in the discharging zone is coated with fluorescent powder on the surface thereof and is formed by glass or sheet glass having at least one opening defined on the glass to ensure the passage of air. The present invention advantages preferable ruminant efficiency as 15 to 20% higher as that of the conventional products, increasing the thermal resistance between the high-temperature circular discharging zone of the plasmic arc and the power coupler to decrease the heat generated by the corresponding radiation conduction for the inner, so that a large power is enabled by the present invention, accomplishing a performance of 200-300 W of the lighting power, and attaining a 75-85 Lm/W of the ruminant efficiency.

9 Claims, 4 Drawing Sheets

ELECTRODLESS GLOBE FLORESCENT LAMP WITH HIGH LUMINANT EFFICIENCY

BACKGROUND OF THE INVENTION

1. Field of the Invention

The present invention relates to an electric lamp, in particularly to a novel electrodless globe florescent lamp having high ruminant efficiency.

2. Description of the Related Art

A conventional electrodless globe florescent lamp as shown by FIG. 1 comprises a globe shield 1', an inner 2' disposed inside said shield, and a power coupler installed inside said inner 2'. Wherein, said power coupler is consisted of a ferrite power coupling magnetic core 42', a weaving line 44', and a radiating stick 46'.

The truth is that, the electrodes readily affect the lighting life of the lamp. Therefore, the elimination of electrodes results in the lamp of an unmatched life, so that the illuminant of the electrodless lamp has the efficiency of a preferable long life, a favorable energy-saving effect, and a higher illuminant performance than those of the conventional lamp. As a result, the electrodless lamp can be extensively adapted to various illuminating occasions.

The electrodless florescent lamp relies on the same ruminant fundamental principles as those of a daylight lamp. The free electrons in the lamp are excited by an electromagnetic field to result in acceleration. Whereby, the kinetic electrons collide with the mercury atoms to excite the mercury atoms if the kinetic energy of the electrons is large enough, so that the kinetic energy of the electrons would be absorbed by the mercury atoms to be converted into an excited state. That is to say, the electrons within the mercury are leveled up from a lower stable level to a higher energy state. However, the electrons of the higher energy state are unstable; that is, the electrons would readily fall back to a ground state. When the excited electrons in the atoms fall back to the ground state, the absorbed energy would be emitted as a radiation photon (253.7 nm UV). In this manner, the UV radiation is converted and cooperated with fluorescent powder coated on the surface of the lamp to visible light.

Moreover, since the electrons do not exist in the electrodless florescent lamp, the power to keep the lamp lighting counts on an electromagnetic coupling, which is specifically directed to a power coupler. An energy source of 50 Hz or 60 Hz power frequency provides the electrodless florescent lamp with electric power; whereby, the energy source would then be converted into a high frequency power of 50 to 1000 KHZ to feed a primary winding of a transformer. Further, the plasmic arc developed by the ionizing discharging of an inert gas and the mercury vapor would become a secondary winding of the transformer. The lamp power coupling between the primary and secondary windings would be completed via the high frequency transformer, so that the transmission of the electric energy within the electrodless florescent lamp can be performed.

In addition, the heat of a magnetic core of the electrodless fluorescent lamp's power coupler is produced by the consumption of the magnetic core working in a high frequency, the plasmic arc's thermal radiating conduction through the gas discharging from the electrodless globe fluorescent lamp, and the inner glass's heating temperature via an inelastic collision between the ion and the glass of the inner. Especially, the plasmic arc's thermal radiating conduction through the gas discharging from the electrodless globe fluorescent lamp and the inner glass's heating temperature via an inelastic collision between the ion and the glass of the inner are two of the main factors to induce the heating temperature of the magnetic core of the power coupling. However, the temperature of a working environment of the magnetic core of the power coupler is higher, which is up to 230□ to 250□, so the competence of the power coupler is more adapted to a magnetic core made of manganese and zinc, which have a less power consumption within the frequent scope of 50 to 1000 KHz. Nevertheless, the curie points of the magnetic core made by the above materials are lower to 220□ to 230□. That is to say, the power coupler is hard to work under the condition of a high temperature over the curies points because an unbuilt state would readily occur.

Wherein, if the distance between the magnetic core of the power coupler and the inner is increased, a thermal resistance between the circular discharging zone of the plasmic arc and the power coupler can be accordingly augmented, so that the working temperature of the magnetic core of the power coupler can be lessened. However, the initial ionized discharging of the electrodless fluorescent lamp mainly depends on the circulation of a discharging mode of E-field (capacitive coupling discharge) converted into a discharging mode of H-field (induction field coupling discharge). Whereby, during the initial discharging of the E-field mode, the energy source thereof is provided by a distributed capacitance between the magnetic core winding of the power coupler and the discharging zone of the lamp gas. That is to say, the efficiency of the discharging of the E-field mode is directly affected by the capacity of the capacitance, but the distributed capacitance between the magnetic core winding of the power coupler and the gas discharging zone within the shield would be accordingly lessened by the enlargement of the distance therebetween. As a result, the lessened distributed capacitance would lead the E-field mold to an unavailable discharging, and the electrodless fluorescent lamp could not be started. Therefore, simply increasing the distance between the magnetic core winding of the power coupler and the gas discharging zone of the inner gas to boost the thermal resistance between the circular discharging zone of the plasmic arc and the power coupler is not an available method.

There is also an increment of a metal heat-conducting bar (made by copper or aluminum or other suitable metals) on the magnetic core of the power coupler to remove the heat on the magnetic core of the power coupler, traditionally, but the competence thereof is however not remarkable. The development of this kind of electrodless globe lamp is contrarily limited, especially to those with large powers.

SUMMARY OF THE INVENTION

The object of the present invention is to increase the luminous efficiency of an electrodless globe fluorescent lamp by simplifying the radiating requirement of a power coupler to ensure a magnetic core of the power coupler can be adapted under the Curie point, so that a electrodless globe florescent lamp with large power can be achieved to perform its high radiant efficiency.

The electrodless globe florescent lamp having high ruminant efficiency of the present invention essentially includes a globe shield and an inner disposed inside the shield. Whereby, a plasmic arc discharging zone being airtightly enclosed by the shield and the inner. Further a division device is defined between the inner and the shield of the electrodless fluorescent lamp.

Alternatively, at least one opening is defined on the division device.

Alternatively, the division device adopts glass.

Alternatively, the division device is installed in the plasmic arc discharging zone near the inner.

Alternatively, an inner surface of the division device is coated by fluorescent powder, an outer surface of the division device is coated by fluorescent powder, or both of the inner and outer surfaces of the division device are coated by fluorescent powder.

Alternatively, the division device is directed to a glass pipe. Moreover, one end of the glass pipe at the inner as well as the inner are both sealed at an open end of the shield, and the other end of the glass pipe is closed up. In addition, at least one opening is defined on a periphery of the glass pipe.

Alternatively, the opening has a uniform dimension and is equidistantly defined on the periphery of the glass pipe.

Alternatively, the division device is directed to a glass tube; the glass tube covers on an outer side of the inner and has an upper opening and a lower opening; the glass tube is fixed on the inner.

Alternatively, the division device is directed to a glass tube; the glass tube covers on an outer side of the inner; whereby, a bottom end of the glass tube is fixed on the shield, and a top end of the glass tube is opened.

Alternatively, the division device is directed to a glass tube; a top end of the glass tube is fixed above the inner, and a bottom end of the glass tube is opened, so that the glass tube is fixed on the inner.

Alternatively, the division device is directed to a double-glazing hollow glass tube, and the glass tube is fixed on the inner having at least one opening.

Alternatively, the division device is directed to at least one sheet glass fixed and combined on the inner.

Thus, the present invention has the following advantages:

1. Since the circular discharging zone of the plasmic arc between the discharging area formed by the inner and the shield is disposed near the inner to provide the division device covering on the inner, the thermal resistance between the high-temperature circular discharging zone of the plasmic arc and the power coupler is accordingly increased. Therefore, the heat generated by the high-temperature radiating conduction from the circular discharging zone of the plasmic arc to the glass inner can be correspondingly decreased, so that the influence of the high temperature of the discharging area on the magnetic core's temperature in the power coupler of the electrodless globe lamp's discharging area is greatly reduced. Further, the requirement of the efficiency of the magnetic core (Curie point) for the power coupler of the electrodless globe fluorescent lamp is also diminished so as to simplify the radiating condition of the power coupler and enable the electrodless globe fluorescent lamp having a large power.
2. Due to that the division device is disposed between the inner and the shield, the loss of charged particles in a positive column to discharge during a low pressure is directed to the loss from a bipolar diffusion motion to the pipe wall. In this manner, the bipolar diffusion motion of the most charged particles would be received by the division device for avoiding an inelastically collision with the inner to prevent from the increment of the temperature thereof. As a result, the temperature of the inner glass can be decreased.
3. The disposition of the division device alters the position of the circular discharging area formed by plasma within the shield. Therefore, the discharging circulation of the plasmic arc can be disposed further near the outer circumference to shorten the photon's distance from the plasma area to the fluorescent powder inside the lamp pipe. Thus, the probability of the resonated radiation to be absorbed can be accordingly reduced to enhance the using efficiency of the UV photon.
4. An additive glass pipe or sheet glasses are disposed near the inner in the circular discharging zone of the plasmic arc, and the fluorescent powder existing on the additive glass pipe or sheet glasses would consequently result in an increment of the ruminant area of the fluorescent powder to advance the lighting efficiency of the electrodless globe fluorescent lamp system.

The above advantages preferably advance the bright efficiency of the electrodless globe fluorescent lamp system. Favorably, the present invention promotes the radiant efficiency as 15 to 20% higher as that of the conventional products. Therefore, the thermal resistance between the high-temperature circular discharging zone of the plasmic arc and the power coupler is accordingly increased. In addition, the heat generated by the high-temperature radiation conduction from the circular discharging zone of the plasmic arc to the glass inner can be correspondingly decreased so as to enable the electrodless globe fluorescent lamp having a large power. That is to say, the lighting power can accomplish the performance of 200 to 300 W, and the luminance efficiency can attain the performance of 75 to 85 Lm/W.

DETAILED DESCRIPTION OF THE PREFERRED EMBODIMENTS

An electrodless globe florescent lamp with high luminant efficiency of the present invention comprises a globe shield and an inner disposed inside the shield. A plasmic arc discharging zone is solid enclosed by the shield and the inner. Characterized in that, a division device is defined between the inner and the shield. Wherein, the division device is consisted of at least one sheet glass including at least one opening as a vent for the working air traveling through the division device and the inner to be alternated with the working air between the division device and the shield. Therefore, an initial E-field discharging generated from building low-pressured plasma would not be influenced.

Further, the division device is installed in the plasmic arc discharging zone near the inner, and the division device can be directed into a glass pipe or sheet glasses. In addition, an inner surface (near the inner) of the division device is coated by fluorescent powder, an outer surface (near the shield) of the division device is coated by fluorescent powder, or both of the inner and outer surfaces of the division device are coated by fluorescent powder.

Figure 1:
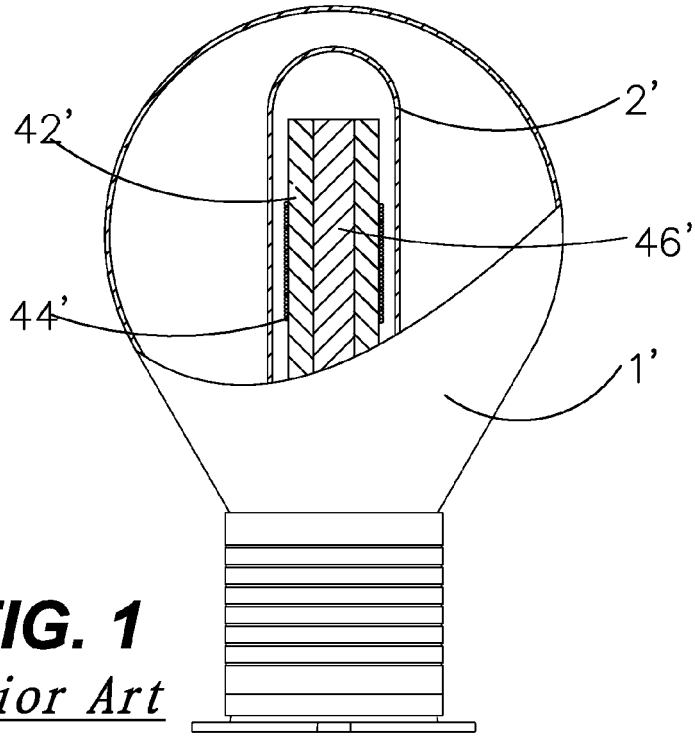
FIG. 1 Prior Art
FIG. 1 is a schematic view showing the structure of an electrodless globe fluorescent lamp of a conventional invention.
Figure 2:
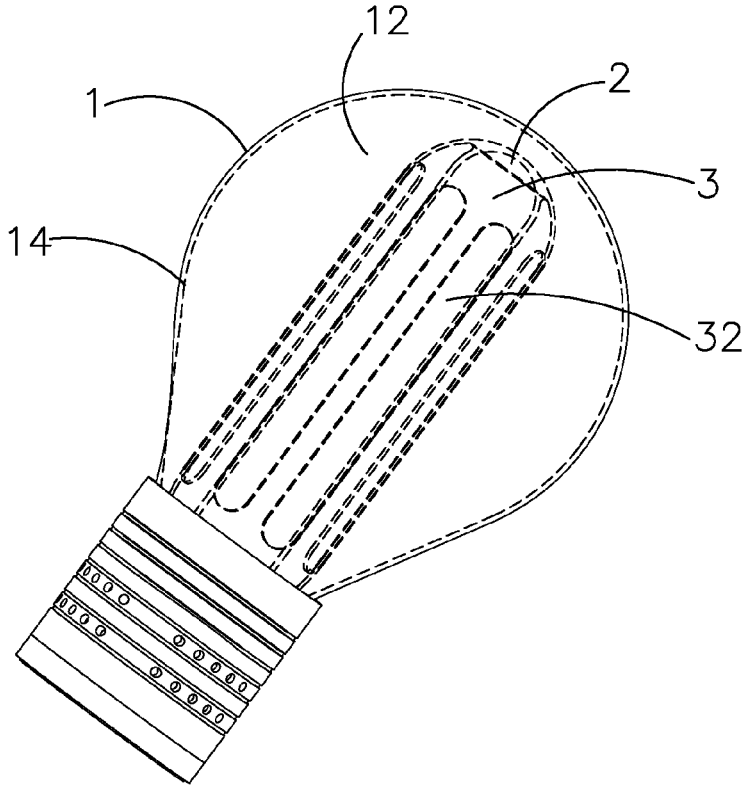
FIG. 2 is a perspective view showing a first preferred embodiment of the present invention.

Referring to FIG. 2 showing a first preferred embodiment of the present invention comprises a globe shield 1 and an inner 2 disposed inside the shield 1. Wherein, a circular discharging zone of the plasmic arc 12 is compactly enclosed by the shield 1 and the inner 2. Moreover, a glass pipe 3 is installed on the circular discharging zone of the plasmic arc 12, and an inner surface of the shield 1 is coated by fluorescent powder 14. Wherein, the circular discharging zone of the plasmic arc 12 further includes a low-pressured discharging working air, such as a mixture of inert gas and mercury vapor. In addition, an inner surface of the glass pipe 3 is coated by fluorescent powder; as it should be, an outer surface of the glass pipe 3 can be also coated by fluorescent powder, or both of the inner and outer surfaces of the glass pipe 3 are coated by fluorescent powder.

A power coupler consisted of a ferrite power coupling magnetic core, weaving line, and radiating stick is disposed inside the inner 2 (not shown).

In this embodiment, the glass pipe 3 is installed in the plasmic arc discharging zone 12 near the inner 2. Furthermore, one end of the glass pipe 3 at the inner 2 as well as the inner 2 are both sealed at an open end of the shield 1, and the other end of the glass pipe 3 is closed up. Four slots 32 are equidistantly defined on the periphery of the glass pipe 3, and the dimensions of the slots 32 are uniform. As it should be, the number of the slots 32 can be directed to one, two, three, or more than four, and the arrangement thereof is not limited to an equidistant disposition as that of this embodiment; preferably, the dimensions of the slots do not have to be completely same, and the aspects of the slots 32 are also not limited to a long and narrow shape, for example of a trapezoid, a triangle, or a square are also available. Alternatively, either one of the top end and the bottom end of the glass pipe 3 does not have to be sealed. In a word, the slots 32 just have to function as a through hole to ensure the working air inside and outside the glass pipe 3 being alternated.

Figure 3:
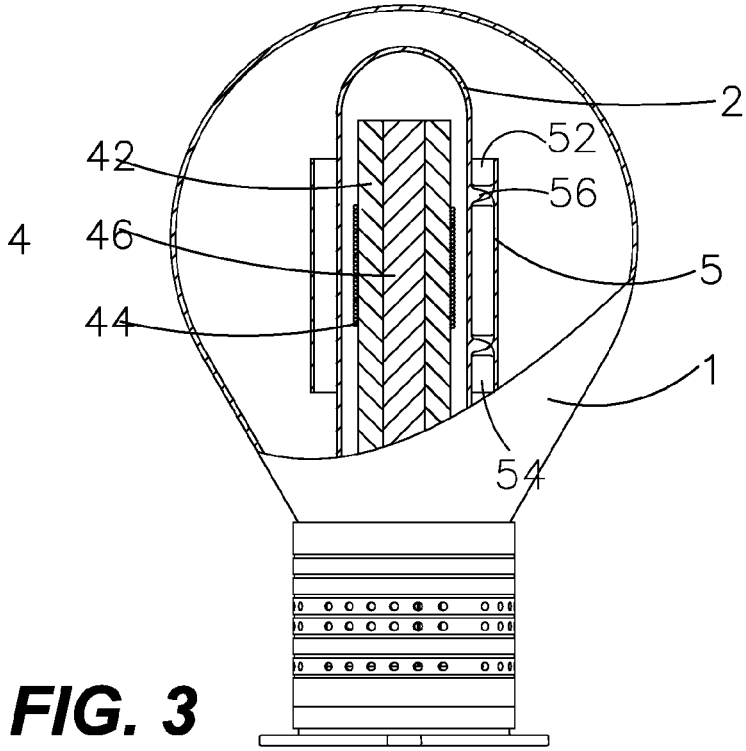
FIG. 3 is a partial sectional view showing a second preferred embodiment of the present invention.

Referring to FIG. 3 showing a second preferred embodiment of the present invention, a power coupler 4 is consisted of a ferrite power coupling magnetic core 42, a weaving line, and a radiating stick 46. Wherein, the power coupler 4 is disposed inside the inner 2, and the configuration of the division device of this embodiment is different from that of the first preferred embodiment. In this embodiment, the division device is directed to a glass tube 5 covering on the inner 2 and having an upper and lower openings 52 and 54. In this method, the working air can be alternated through the inside and the outside of the glass tube 5. Moreover, an outer surface of the glass tube 5 is coated by fluorescent powder. As it should be, an inner surface of the glass tube 5 can be alternatively coated by fluorescent powder, or both of the inner and outer surfaces of the glass tube 5 are coated by fluorescent powder.

In this embodiment, the glass tube 5 is fixed on the inner 2 by a pair of glass fasteners 56 respectively fixed on the top and the bottom of the inner 2. Alternatively, the number of the glass fasteners can be arbitrarily increased or decreased, or other appropriate fixing manner is also available as long as the glass tube 5 is assured to be fixed on the inner 2.

Figure 4:
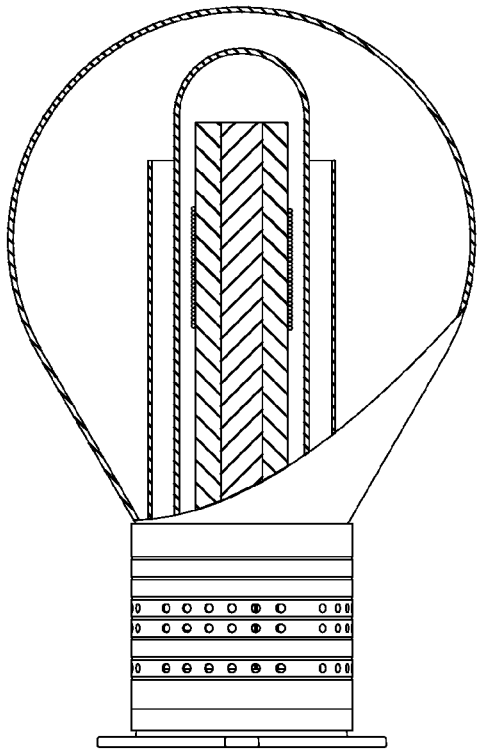
FIG. 4 is a partial sectional view showing a third preferred embodiment of the present invention.

Referring to FIG. 4 shows a third preferred embodiment of the present invention. The difference between this embodiment and the second embodiment is that a bottom end of the glass tube 5 is fixed on the shield 1, and a top end of the glass tube 5 is opened.

Figure 5:
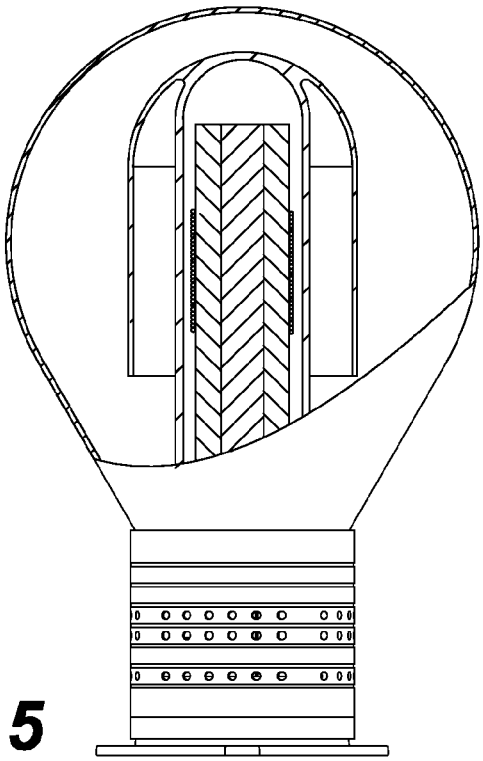
FIG. 5 is a partial sectional view showing a fourth preferred embodiment of the present invention.

Referring to FIG. 5 shows a fourth preferred embodiment of the present invention; different from that of the second embodiment in that, a top end of the glass tube 5 is sealed above the inner 2 and a bottom end of the glass tube 5 is opened.

Figure 6:
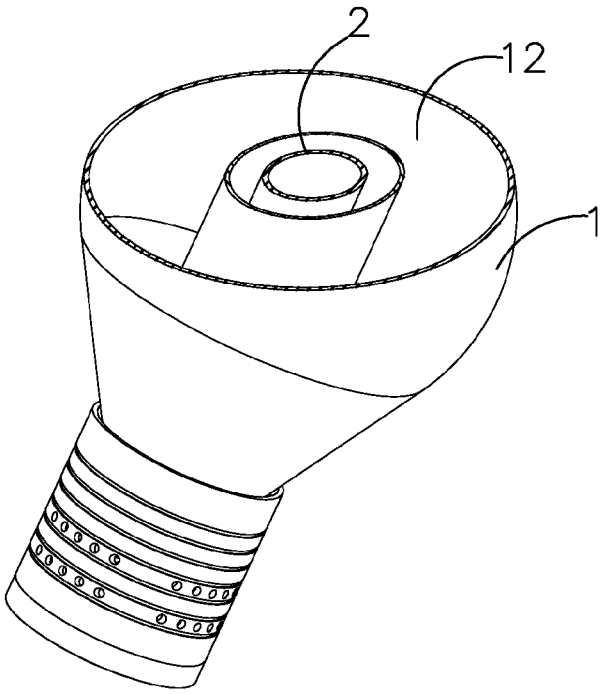
FIG. 6 is a sectional view showing the second, third, and fourth preferred embodiments of the present invention.

FIG. 6 is a sectional view shows the second, third, and fourth embodiments.

Figure 7:
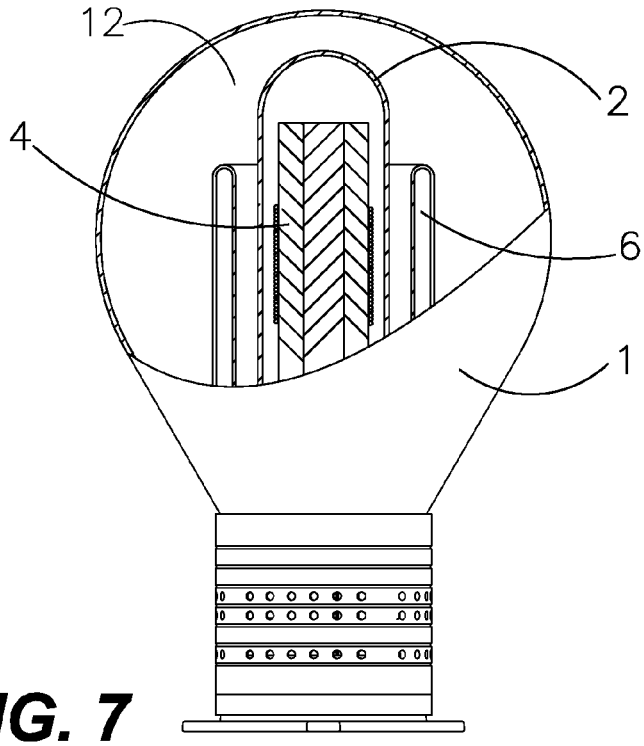
FIG. 7 is a partial sectional view showing a fifth preferred embodiment of the present invention.

Referring to FIG. 7 showing a fifth preferred embodiment of the present invention. The structure of this embodiment is different from that of the second embodiment in that: the division device is directed to a double-glazing hollow glass tube 6 having a top and a lower openings on the top and the bottom ends thereof, respectively. Or alternatively, the bottom end of the double-glazing hollow glass tube 6 is fixed on the shield 1, and the glass tube 6 only has one opening on the top end thereof; or preferably, the glass tube only has one opening on the bottom end thereof with a sealed top end above the inner 2.

The exposed surfaces of the inner and outer glass tube 6 are coated in fluorescent powder.

Figure 8:
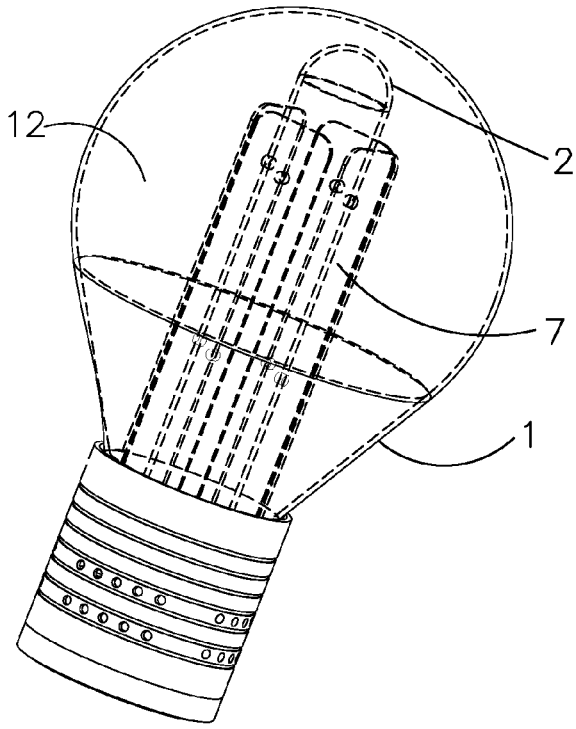
FIG. 8 is a partial sectional view showing a sixth preferred embodiment of the present invention.

Referring to FIG. 8 showing a sixth preferred embodiment of the present invention has a different structure from that of the first embodiment. Wherein, the division device around the circular discharging zone of the plasmic arc 12 is not a glass pipe, but at least one sheet glass 7. Moreover, in this embodiment, four rectangular sheet glasses 7 of the same dimension are installed in the plasmic arc discharging zone 12 near the inner 2. Further, each of the sheet glasses 7 is parallel to the inner 2 with their bottom ends fixed on the shield 1 and their top ends fixed on the inner 2 through the glass fastener. As it should be, the number of the sheet glass 7 can be directed to one, two, three, or more than four, and the arrangement thereof is not limited to an equidistant disposition as that of this embodiment; preferably, the aspects of the sheet glass 7 are also not limited to a rectangle, for example of a trapezoid, a triangle, or a square are also available. Especially, the sheet glass 7 can also be suspended in midair near the inner 2 and the top as well as the bottom end would be accordingly and respectively fixed on the inner 2 through glass fasteners.

It should be noted that the division devices of the above embodiments are not limited a single layer. That is to say, the division device between the shield and the inner can be further added to two, three, or more layers with the same or different structures thereof.

By the additive division device such as a glass pipe or the sheet glass disposed in the circular discharging zone of the plasmic arc near the inner, the thermal resistance of the high-temperature circular discharging zone of the plasmic arc to the power coupler in the shield is increased. As a result, the working temperature generated from the high temperature of the circular discharging zone of the plasmic arc to the inside of the circular discharging zone of the plasmic arc (the magnetic core of the power coupler) can be greatly decreased so as to diminish the requirement of the power coupler of the electrodless globe fluorescent lamp for the properties of the magnetic core (Curie point). Consequently, the radiating condition of the power coupler can be simplified to enable the electrodless globe fluorescent lamp having a large power.

Since the division device is disposed between the inner and the shield, a loss of charged particles in a positive column to discharge of the plasma is justly directed to the loss from the bipolar diffusion motion to the pipe wall. The bipolar diffusion motion of most charged particles are absorbed by the division device to avoid a heating temperature of the inner through an inelastic collision with the inner, so that the inner temperature can be accordingly decreased.

As a result, the structure above facilitates lowering the working temperature of the magnetic core of the power coupler, which contents the smaller loss value from a relationship curve of the working magnetic core to the temperature loss, so that the coupling efficiency of the circuit can be promoted.

The arrangement of the division device alters the space formed by the plasma in the globe (the circular discharging zone of the plasmic arc), so that the discharging coil of the plasmic arc would be more close to the wall of the shield, and the distance between the photons traveling to the fluorescent powder coated inside the lamp in the plasma area can be shortened to decrease the probability of being absorbed by resonated radiation and promote the using efficiency of UV photon.

The division device is coated with fluorescent powder to increase the effective lighting area of the fluorescent powder, so that the luminance efficiency of the electrodless fluorescent lamp system can be correspondingly promoted.

The table below is a comparison data showing the differences between the luminance efficiencies and the magnetic cores of the power couplers of the convention and present invention. Apparently, the present invention installing the division device assists the electrodless globe fluorescent lamp system in a high lighting efficiency.

CHART 1

A comparison data shows the differences between the radiant efficiencies and the magnetic cores of the power couplers of the convention and present invention.

| | Testing product Serial number | Power voltage (ACV) | Lighting time (M) | Testing power (W) | Luminous flux (Lm) | System luminance efficiency (Lm/W) | Temperature of the power coupling magnetic core C. | Temperature of the power coupling winding C. |
|---|---|---|---|---|---|---|---|---|
| The second preferred embodiment of the present invention-the division device is a tube (¢ 54 × 80 mm) | 1# | 220.2 | 120 | 210.2 | 16642.8 | 79.18 | 155 | 185 |
| | 3# | 220.1 | 120 | 215.4 | 16766.2 | 77.84 | 158 | 187 |
| | 5# | 219.8 | 120 | 224.6 | 17244.9 | 76.78 | 162 | 191 |
| | 7# | 220.6 | 120 | 249.6 | 18935.1 | 75.86 | 167 | 194 |
| A conventional electrodless globe fluorescent lamp | 1# | 220.3 | 120 | 165.3 | 10609.7 | 64.3 | 180 | 220 |
| | 2# | 220.1 | 120 | 210.4 | 13125.3 | 62.5 | 198 | 231 |

While we have shown and described the embodiment in accordance with the present invention, it should be clear to those skilled in the art that further embodiments may be made without departing from the scope of the present invention.

I claim:

1. An electrodless globe florescent lamp with high ruminant efficiency comprising a globe shield and an inner disposed inside said shield; a plasmic arc discharging zone being enclosed by said shield and said inner; further, a power coupler being installed inside said inner; wherein, at least a layer of division device being defined between said inner and said shield, wherein said division device adopts glass.

2. The florescent lamp as claimed in claim 1, wherein an inner surface of said division device is coated by fluorescent powder, an outer surface of said division device is coated by fluorescent powder, or both of said inner and outer surfaces of said division device are coated by fluorescent powder.

3. The florescent lamp as claimed in claim 1, wherein said division device is directed to a glass pipe; one end of said glass pipe at said inner and said inner are both sealed at an open end of said shield, and the other end of said glass pipe is closed up; and at least one opening is defined on a periphery of said glass pipe.

4. The florescent lamp as claimed in claim 3, wherein said opening has a uniform dimension and is equidistantly defined on said periphery of said glass pipe.

5. The florescent lamp as claimed in claim 1, wherein said division device is directed to a glass tube; said glass tube covers on an outer side of said inner and has an upper opening and a lower opening; and said glass tube is fixed on said inner.

6. The florescent lamp as claimed in claim 1, wherein said division device is directed to a glass tube; said glass tube covers on an outer side of said inner;

whereby a bottom end of said glass tube is fixed on said shield, and a top end of said glass tube is opened.

7. The florescent lamp as claimed in claim 1, wherein said division device is directed to a glass tube; a top end of said glass tube is sealed above said inner, and a bottom end of said glass tube is opened, for said glass tube being fixed on said inner.

8. The florescent lamp as claimed in claim 1, wherein said division device is directed to a double-glazing hollow glass tube, and said glass tube is fixed on said inner having at least one opening.

9. The florescent lamp as claimed in claim 1, wherein said division device is directed to at least one sheet glass fixed and combined on said inner.

* * * * *